United States Patent [19]

Dhelft

[11] 4,121,809

[45] Oct. 24, 1978

[54] COOLING PLATE FOR SHAFT FURNACES

[75] Inventor: Patrick Dhelft, Paris, France

[73] Assignee: Sofresid, Societe Francaise d'Etude d'Installations Siderurgiques, Montreuil-sous-Bois, France

[21] Appl. No.: 829,465

[22] Filed: Aug. 31, 1977

[30] Foreign Application Priority Data

Nov. 23, 1976 [FR] France ..... 76 35207

[51] Int. Cl.[2] ..... C21B 7/10

[52] U.S. Cl. ..... 266/193

[58] Field of Search ..... 266/190, 192–194

[56] References Cited

U.S. PATENT DOCUMENTS

| | | | |
|---|---|---|---|
| 1,732,514 | 10/1929 | Hunter | 122/6 A |
| 2,671,658 | 3/1954 | Moore | 266/192 |
| 2,789,881 | 4/1957 | Hochmuth | 266/193 |
| 2,805,851 | 9/1957 | Becker et al. | 266/193 |
| 3,984,089 | 10/1976 | van Laar | 266/193 |
| 4,033,561 | 7/1977 | Dhelft | 266/193 |

*Primary Examiner*—Gerald A. Dost

*Attorney, Agent, or Firm*—Wenderoth, Lind & Ponack

[57] ABSTRACT

A cooling plate for circulating fluid for cooling the walls of shaft furnaces and particularly blast furnaces, and being placed between the refractory material to be cooled and the facing of the furnace to be protected and comprising a flat thin-walled panel made of cast steel and forming a tightly sealed enclosure through which passes an independent stream of cooling fluid, this enclosure being divided up into tubular passages with the aid of partitions which delimit a single circulatory path for the cooling medium which circulates in a vertical upward sinusoidal movement, that face of the plate which faces the interior of the blast furnace to be protected being lined with a high-strength refractory material.

3 Claims, 4 Drawing Figures

COOLING PLATE FOR SHAFT FURNACES

BACKGROUND OF THE INVENTION

The present invention relates to a cooling plate for circulating fluid for cooling the walls of shaft furnaces and more particularly, but not exclusively, to the cooling of the refractory walls of blast furnaces, and is an improvement or modification of the invention of my U.S. Pat. No. 4,033,561 of July 5, 1977 which claims:

A cooling plate for circulating fluid for cooling the walls of shaft furnaces and particularly blast furnaces, the plate being placed between the refractory material to be cooled and the facing of the furnace to be protected, said cooling plate comprising:

a frame formed by two bent tubular elements welded at their ends to separator plates, an independent stream of cooling fluid passing through each tubular element; and a flat hollow central element comprising an inner double-walled panel welded to the inner periphery of the frame, said inner panel forming an enclosure through which passes an independent stream of the cooling fluid.

SUMMARY OF THE INVENTION

The present invention particularly relates to a cooling plate having only one cooling circuit. The cooling plate is intended to be fitted in the body of a blast furnace, that is to say in the zone of the furnace that is very heavily loaded thermally and mechanically but that cannot be lined, the scale and fused metal being formed only below such zone.

According to the invention there is provided a cooling plate for circulating fluid for cooling the walls of shaft furnaces and particularly blast furnaces, the plate being placed between the refractory material to be cooled and the facing of the furnace to be protected and comprising a flat thin-walled panel made of cast steel and forming a tightly sealed enclosure through which passes an independent stream of cooling fluid, this enclosure being divided up into tubular passages with the aid of partitions which delimit a single circulatory path for the cooling medium which circulates in a vertical upward sinusoidal movement, that face of the plate which faces the interior of the blast furnace to be protected being lined with a high-strength refractory material.

Preferably, the high-strength refractory lining of that face of the plate that faces the interior of the blast furnace is of honeycomb form.

Further, the lining is made preferably of very hard refractories of high thermal conductivity, for example of the silicon carbide type.

BRIEF DESCRIPTION OF THE DRAWING

In order that the invention may be more readily understood, a specific embodiment thereof will now be described, by way of example and with reference to the accompanying drawings in which.

DETAILED DESCRIPTION OF THE INVENTION

Figure 1:
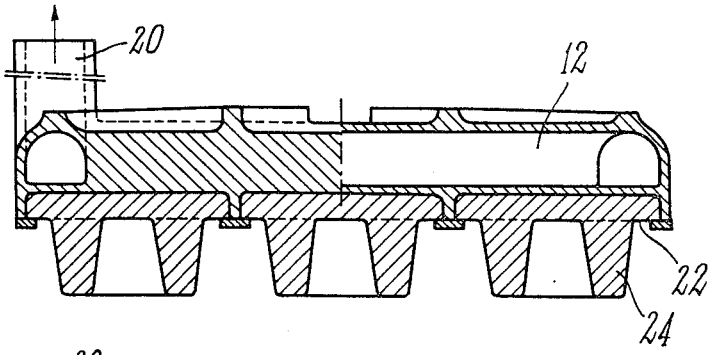
FIG. 1 is a transverse cross-section of a cooling plate in accordance with this invention.

Referring to the drawings, it will be seen that the cooling plate in accordance with the invention takes the form of a flat panel 10 made of cast steel and forming a tightly sealed enclosure 12 in which an independent stream of cooling fluid can be caused to circulate. This enclosure 12 is divided up into a plurality of tubular passages 14 by means of partitions 16. Thus, a single circulatory path is formed for the cooling medium which circulates in the cooling plate in an upward vertical sinusoidal movement. For this purpose, the plate has at its base an inlet 18 for the cooling fluid, and, at its top, an outlet 20. Thus, high-velocity circulation of the cooling fluid is achieved, and the fluid sweeps the entire surface of the plate and ensures efficient and uniform cooling.

Figure 2:
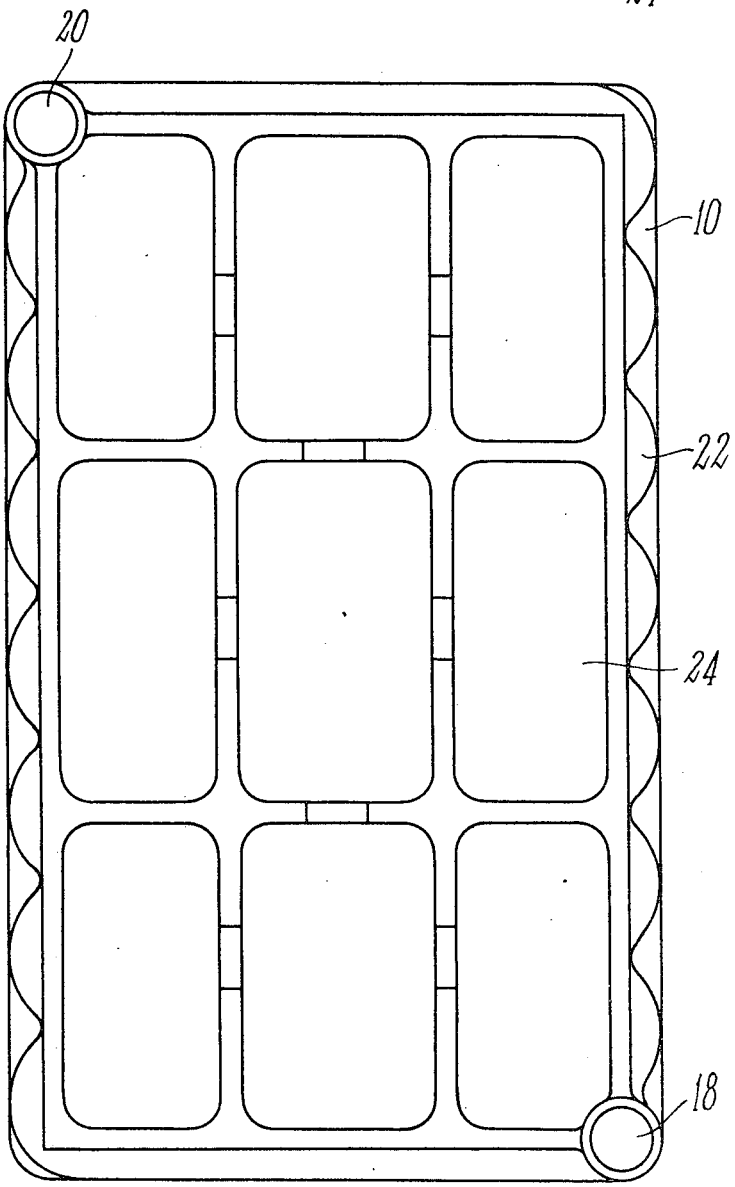
FIG. 2 is a plan view of the exterior face of the plate.
Figure 3:
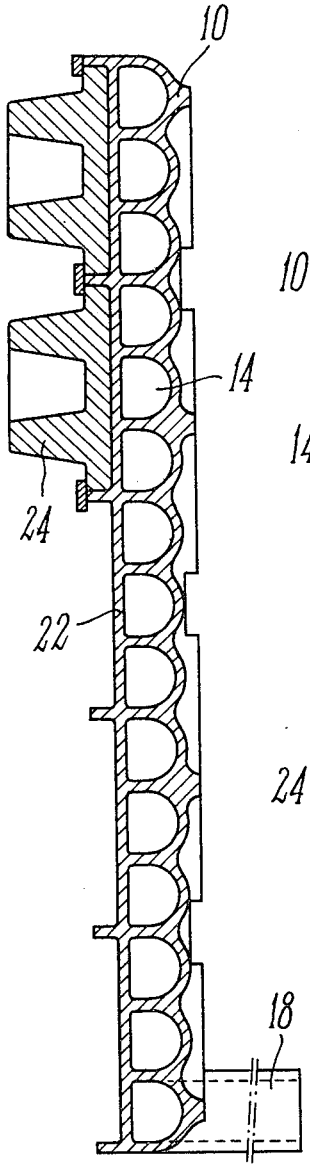
FIG. 3 is a longitudinal cross-section showing the plate partially covered by high-strength refractory.
Figure 4:
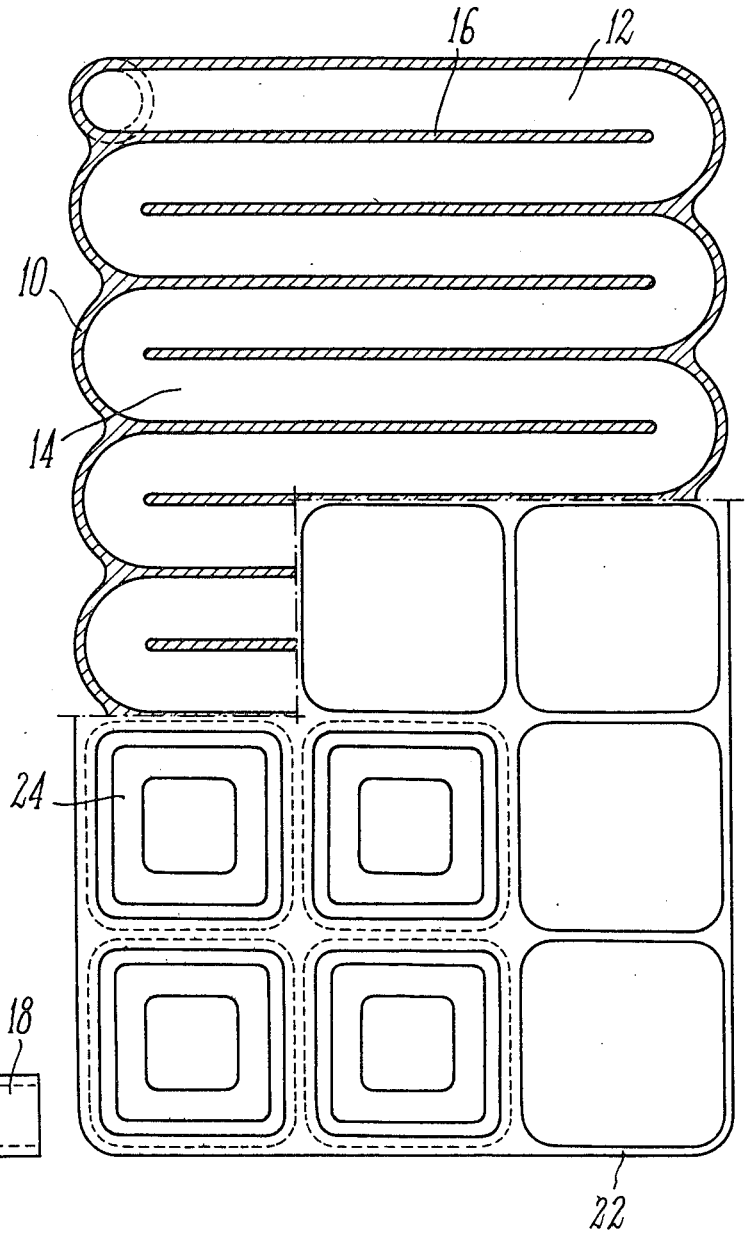
FIG. 4 is a plan view of the interior face of the cooling plate, part of the plate being shown as broken away.

As described in the Specification of U.S. Pat. No. 4,033,561, the plates such as that illustrated in the drawing are arranged in juxtaposed relationship between the facing of the furnace and its refractory wall (see FIG. 2*a* In U.S. Pat. No. 4,033,561), the inlets 18 and outlets 20 extending through the facing of the furnace.

In accordance with a preferred feature of this invention, that face 22, i.e. the inner face of the plate, that is presented to the interior of the blast furnace is lined with a thermally-conductive refractory having high-strength, for example silicon carbide. In the arrangement illustrated in the drawings which represents a non-limiting example, the lining is formed with the aid of plates 24 arranged in a honeycomb formation. Each refractory plate preferably has in the side thereof facing the blast furnace a deep recess surrounded and defined by refractory walls.

In a similar manner to that described in the Specification of U.S. Pat. No. 4,033,561, the plates of this invention can be fitted in series, the manner of mounting them in the wall of the blast furnace being the same as that described in the above-mentioned Patent with reference to FIGS. 2*a* and 2*b* thereof.

It will of course be understood that this invention is not limited to the embodiment described and illustrated, but that variations within the scope of the invention are possible.

What I claim is:

1. A cooling plate for circulating fluid for cooling the walls of shaft furnaces and particularly blast furnaces, the plate being placed between the refractory material to be cooled and the facing of the furnace to be protected, said cooling plate comprising:

a flat thin-walled panel forming a tightly sealed enclosure through which passes a single independent stream of cooling fluid, said enclosure being divided by partitions into tubular passages which together define a single sinusoidal circulatory path for the cooling fluid, said panel and said partitions being formed as a single integral member from cast steel;

fluid inlet means at the bottom of said panel and fluid outlet means at the top of said panel for circulating cooling fluid in a vertical upward sinusoidal movement through said path; and that face of said panel which faces the interior of the furnace to be protected being lined with a lining of high-strength refractory material, said lining comprising refractory plates arranged in a honeycomb formation, each said refractory plate having in the side thereof facing the furnace a deep recess defined by refractory walls.

2. A cooling plate as claimed in claim 1, wherein said refractory material of said refractory plates comprises silicon carbide.

3. A cooling plate as claimed in claim 1, the plate being provided in a furnace in combination with other identical plates which are fitted in juxtaposed relationship and which are arranged in series.

* * * * *